US005554473A

United States Patent [19]

Cais et al.

[11] Patent Number: 5,554,473

[45] Date of Patent: Sep. 10, 1996

[54] PHOTORECEPTOR HAVING CHARGE TRANSPORT LAYERS CONTAINING A COPOLYCARBONATE AND LAYER CONTAINING SAME

[75] Inventors: Rudolf E. Cais; Frederick W. Gerriets, both of Virginia Beach, Va.

[73] Assignee: Mitsubishi Chemical America, Inc., White Plains, N.Y.

[21] Appl. No.: 348,061

[22] Filed: Nov. 23, 1994

[51] Int. Cl.[6] ..... G03G 5/047; H01B 1/20

[52] U.S. Cl. ..... 430/59; 430/58; 430/96; 252/500

[58] Field of Search ..... 430/58, 59, 96; 252/500

[56] References Cited

U.S. PATENT DOCUMENTS

| | | | |
|---|---|---|---|
| Re. 33,724 | 10/1991 | Takei et al. | 430/59 |
| 3,037,861 | 6/1962 | Hoegl et al. . | |
| 3,232,755 | 2/1966 | Hoegl et al. . | |
| 3,271,144 | 9/1966 | Clausen et al. . | |
| 3,287,120 | 11/1966 | Hoegl . | |
| 3,573,906 | 4/1971 | Goffe . | |
| 3,725,058 | 4/1973 | Hayashi et al. . | |
| 3,837,851 | 9/1974 | Shattuck et al. . | |
| 3,839,034 | 10/1974 | Wiedemann . | |
| 3,850,630 | 11/1974 | Regensburger et al. . | |
| 4,637,971 | 1/1987 | Takei et al. | 430/59 |
| 4,746,756 | 5/1988 | Kazmaier et al. | 564/307 |
| 4,792,508 | 12/1988 | Kazmaier et al. | 430/59 |
| 4,808,506 | 2/1989 | Loutfy et al. | 430/59 |
| 4,833,052 | 5/1989 | Law et al. | 430/58 |
| 4,855,201 | 8/1989 | Badesha et al. | 430/58 |
| 4,874,682 | 10/1989 | Scott et al. | 430/59 |
| 4,882,254 | 11/1989 | Loutfy et al. | 430/59 |
| 4,925,760 | 5/1990 | Baranyi et al. | 430/59 |
| 4,937,164 | 6/1990 | Duff et al. | 430/58 |
| 4,946,754 | 8/1990 | Ong et al. | 430/59 |
| 4,952,471 | 8/1990 | Baranyi et al. | 430/59 |
| 4,952,472 | 8/1990 | Baranyi et al. | 430/59 |
| 4,959,288 | 9/1990 | Ong et al. | 430/59 |
| 4,983,482 | 1/1991 | Ong et al. | 430/59 |
| 5,008,169 | 4/1991 | Yu et al. | 430/59 |
| 5,011,906 | 4/1991 | Ong et al. | 528/176 |
| 5,030,533 | 7/1991 | Bluhm et al. | 430/59 |
| 5,034,296 | 7/1991 | Ong et al. | 430/59 |
| 5,055,367 | 10/1991 | Law | 430/59 |
| 5,066,796 | 11/1991 | Law | 540/140 |
| 5,077,160 | 12/1991 | Law et al. | 430/59 |
| 5,077,161 | 12/1991 | Law | 430/59 |
| 5,080,987 | 1/1992 | Odell et al. | 430/48 |
| 5,106,713 | 4/1992 | Law | 430/59 |
| 5,130,217 | 7/1992 | Champ et al. | 430/59 |
| 5,213,924 | 5/1993 | Sakamoto | 430/96 X |
| 5,227,458 | 7/1993 | Freitag et al. | 528/196 |
| 5,382,489 | 1/1995 | Ojima et al. | 430/58 X |

FOREIGN PATENT DOCUMENTS

| | | | |
|---|---|---|---|
| 37860 | 2/1992 | Japan | 430/96 |

OTHER PUBLICATIONS

*Encyclopedia Of Electronics,* S. Gibilisco and N. Sclater, Eds., Tab Professional and References Books, Blue Ridge Summit, PA (1990), pp. 669–671.

*Kirk–Othmer, Encyclopedia of Chemical Technology,* 4th Ed., 9, pp. 245–277, Wiley, NY, (1994).

*Macromolecules,* (1992), 25, 4588–4596, Cais et al.

*Primary Examiner*—Roland Martin

*Attorney, Agent, or Firm*—Oblon, Spivak, McClelland, Maier & Neustadt, P.C.

[57] ABSTRACT

Organic photoconductive imaging receptors in which the charge transport layer contains, as a binder, a copolycarbonate of 1,1-bis-(4-hydroxyphenyl)-3,3,5-trimethylcyclohexane and 2,2-bis-(4-hydroxylphenyl)propane exhibit excellent wear resistance.

10 Claims, 5 Drawing Sheets

PHOTORECEPTOR HAVING CHARGE TRANSPORT LAYERS CONTAINING A COPOLYCARBONATE AND LAYER CONTAINING SAME

BACKGROUND OF THE INVENTION

1. Field of the Invention

The present invention relates to charge transport layers which contain a copolycarbonate resin with a specified molecular structure that imparts improved durability over a broad range of operating temperatures. The present invention also relates to organic photoconductive imaging receptors which contain such a charge transport layer.

2. Discussion of the Background

A general discussion of electrophotography (photocopying) is given in Kirk-Othmer, *Encyclopedia of Chemical Technology*,4th ed, vol. 9, pp. 245–277, Wiley, New York (1994), and a brief description of laser beam printing is provided in *Encyclopedia of Electronics,* 2nd ed, Gibilisco et al, Eds., pp. 669–671, TAB BOOKS, Blue Ridge Summit, Pa. (1990), both of which are incorporated herein by reference.

Photoreceptors are the central device in photocopiers and laser beam printers. In most photocopiers and laser beam printers, the photoreceptor surface is contained on the outside surface of a hollow metal cylinder, called a drum. Typically, the drum is made of a metal, such as aluminum, which may be anodized or coated with a thin dielectric layer (injection barrier) which is in turn over coated with photogeneration and photoconduction layers.

Key steps in transfer electrophotography include the charging step, the exposure step, the development step, and the transfer step. In the charging step, gas ions are deposited on the surface of the photoconductor drum. In the exposure step, light strikes the charged photoreceptor surface and the surface charges are neutralized by mobile carriers formed within the photoreceptor layer. Thus, the charge on the surface is transmitted in the exposed areas of the photoconductive layer to the oppositely charged metal substrate of the drum. In the development step, a thermoplastic pigmented powder (toner) which carries a charge is brought close to the photoreceptor so that toner particles are directed to the charged image regions on the photoreceptor. In the transfer step, a sheet of paper is brought into physical contact with the toned photoreceptor and the toner is transferred to the paper by applying a charge to the back side of the paper.

Presently, the most suitable photoconductive imaging receptors for low and medium speed electrophotographic plain-paper copiers and laser printers have a double-layered configuration. Photogeneration of charge carriers (electron-hole pairs) takes place in a thin charge generation layer (CGL), typically 0.5 μm thick, which is coated on a conductive substrate such as an aluminum drum. After photogeneration, mobile carriers (usually holes) are injected into a thicker charge transport layer (CTL), which is about 21 μm thick and coated on top of the CGL, under an electric field gradient provided by a negative surface charge. These holes drift to the outermost layer of the photoreceptor to selectively neutralize surface charger thereby forming a latent electrostatic image, which is subsequently developed by thermoplastic toner.

The physical durability of the organic photoconductive imaging receptor is the major characteristic that determines service lifetime, and such durability depends on the mechanical properties of the surface CTL. The CTL is formulated from two major components. They are electron-donor molecules responsible for hole transport, known as the charge-transport material (CTM), and an appropriate binder resin, which must be amorphous and transparent to light. The CTM is usually a low molecular weight organic compound with arylamine or hydrazone groups, and it is selected primarily on the basis of solubility, compatibility with the binder resin, charge transport property, and electrophotographic cyclic stability. The CTM is a non-reactive binder resin diluent (molecular dopant), and it must be compatible in approximately equal parts by weight with the binder resin to ensure good charge mobility, which involves electron hopping between adjacent molecules of the CTM.

The role of the binder resin is to impart the physical durability necessary for acceptable lifetime under the service conditions encountered in copiers and printers. It is well known that the most suitable binder resins belong to the general class of aromatic polycarbonates (PCR), which exhibit such desirable characteristics as solubility (to allow film coating from solution), high carrier mobility, compatibility with the CTM, transparency, durability, adhesion to the CGL, and so on. The simplest and best known example is bisphenol-A polycarbonate (BPA-PCR), more formally called poly[2,2-bis-(4-phenylene)propane carbonate], which has good impact strength and toughness.

However, these attributes of BPA-PCR are degraded by dilution with the CTM. Furthermore, because of its symmetrical structure, BPA-PCR has poor stability in solution, and it also has a tendency to stress crack and phase separate from the charge transport material in the solid state, leading to an opaque charge transport layer with unacceptable performance. Finally, BPA-PCR is not so resistant to surface scratching and abrasion during the copy (print) process, caused by physical contact of the surface of the CTL with paper and machine components designed for the addition and removal of toner.

U.S. Pat. No. Re. 33,724 discloses poly[1,1-bis-(4-phenylene)cyclohexane carbonate], commonly known as BPZ-PCR, a commercial product designated "IUPILON Z" from Mitsubishi Gas Chemical of Japan, as an improved polycarbonate binder resin for organic photoconductive imaging receptors. However, the abrasion resistance properties of organic photoconductive imaging receptors containing BPZ-PCR as a binder in the CTL are not completely satisfactory.

U.S. Pat. No. 5,227,458 discloses polycarbonates obtained from dihydroxydiphenyl cycloalkanes. However, this reference does not disclose any organic photoconductors containing the disclosed polycarbonates. U.S. Pat. No. 5,332,635 discloses electrophotographic photosensitive layers containing a specified polycarbonate.

Abrasion of polymers is a complex phenomenon, involving both surface and bulk properties. Generally, at least two basic kinds of abrasion mechanism are involved: scratch (penetration and plowing of the polymer matrix by a hard asperity); and fatigue (gradual loss of the entire surface layer by repetitive cyclic loading under adhesive contact). Under the actual service conditions of organic photoconductive imaging receptors, there are contributions from several types of abrasion mechanisms, but cyclic fatigue is the major factor. This may be reduced by absorption and dissipation of external stress as internal heat, which can quickly and harmlessly diffuse through the thin CTL into the aluminum substrate, provided there is efficient coupling to a mechanical loss process at the temperature of operation. Otherwise, mechanical stress remains concentrated at the surface, with the likelihood of increased abrasion. It has recently been determined that the resistance of a CTL to mechanical fatigue by cyclic stress correlates with the temperature profile of the dynamic mechanical loss modulus. Two mechanical loss peaks are of significance: 1) the primary relaxation (α peak), which occurs at a higher temperature and results from long-range segmental motion at the glass-transition temperature, $T_g$; and 2) the secondary sub-$T_g$ relaxation (γ peak), which occurs at lower temperature.

However, to date there is no known binder resin which affords a CTL having maximum abrasion resistance, combined with other desirable mechanical performance characteristics such as toughness, impact resistance, and a high heat-distortion temperature. Thus, there remains a need for improved CTL which exhibit increased abrasion resistance and high-temperature rigidity. There also remains a need for organic photoconductive imaging receptors which contain such a CTL.

SUMMARY OF THE INVENTION

Accordingly, it is one object of the present invention to provide novel CTLs which exhibit reduced wear.

It is another object of the present invention to provide novel CTLs which exhibit improved durability over a broad range of operating temperatures, especially at high temperatures.

It is another object of the present invention to provide novel organic photoconductive imaging receptors which contain such a CTL.

These and other objects, which will become apparent during the following detailed description, have been achieved by the inventors' discovery that CTLs which contain a CTM and a copolycarbonate which contains a statistical distribution of monomer units of 1,1-bis-(4-hydroxyphenyl)-3,3,5-trimethylcyclohexane (BPTMC) and 2,2-bis-(4-hydroxyphenyl)propane (bisphenol-A or BPA), in molar ratios of from 1:10 to 10:1, exhibit high durability, meaning improved resistance to abrasion, scratching and impact, and high-temperature rigidity so that the functional life of the CTL and the organic photoconductive imaging receptor containing such a CTL is increased.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DETAILED DESCRIPTION OF THE PREFERRED EMBODIMENTS

Figure 1:
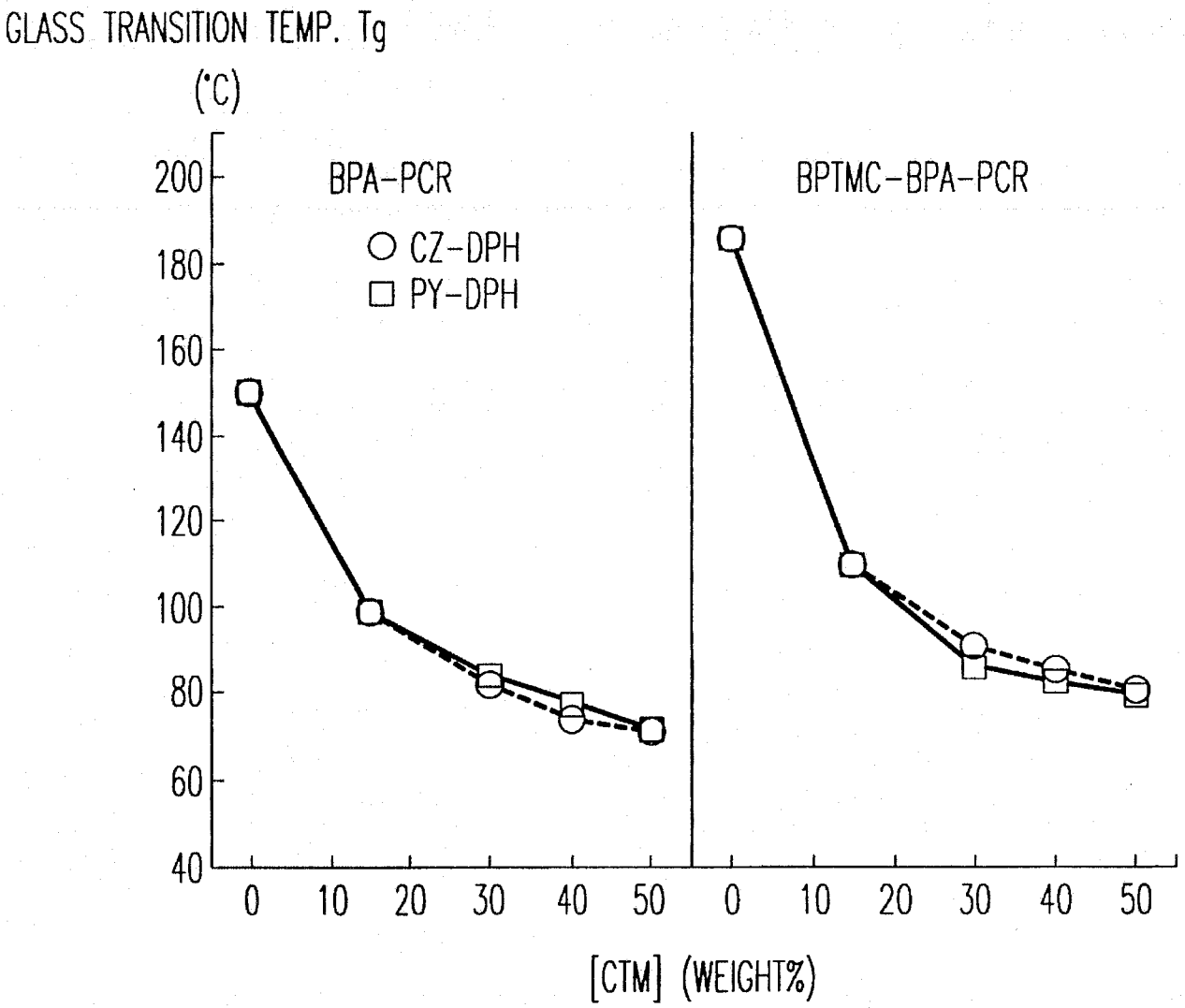
FIG. 1 illustrates graphically the relationship between the glass transition temperature, Tg, of a mixture of a copolycarbonate (either BPA-PCR or BPTMC-BPA-PCR) with a CTM and the amount of CTM present in the mixture (O, CZ-DPH; □, PY-DPH)

Thus, in a first embodiment the present invention provides novel CTLs which comprise a CTM and a copolycarbonate which contains a statistical distribution of monomer units derived from 1,1-bis-(4-hydroxyphenyl)- 3,3,5-trimethylcyclohexane (BPTMC) and 2,2-bis-(4-hydroxyphenyl)propane (BPA). Thus, the present CTLs comprise a copolycarbonate of the formula (I):

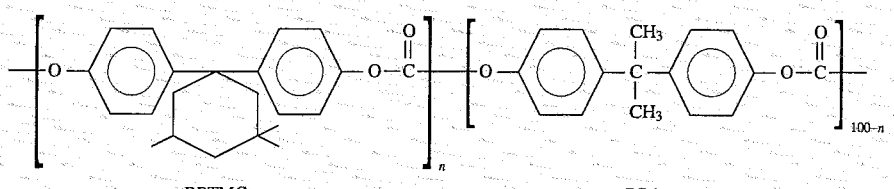

BPTMC BPA in which n is the mole percent of the monomer units derived from BPTMC and 100-n is the mole percent of the monomer units derived from BPA. These copolycarbonates are sometimes referred to hereinafter as BPTMC-BPA-PCR. Suitably n is 10 to 90 mole %, and 100-n is 90 to 10 mole %.

Preferably, n is 25 to 75 mole %, and 100-n is 75 to 25 mole %. Most preferably, n is 30 to 60 mole %, and 100-n is 70 to 40 mole %. Suitably, the viscosity average molecular weight of the copolycarbonate present in the present CTL is 10,000 to 200,000 Daltons, preferably 20,000 to 50,000 Daltons. The copolycarbonates present in the present CTLs may be prepared as described in U.S. Pat. No. 5,277,458, which is incorporated herein by reference. Of course, it is to be understood that the present CTL may contain a single copolycarbonate as described above or a mixture of two or more of such copolycarbonates with various molecular-weight distributions.

The present CTLs comprise, in addition to the above described copolycarbonate, a CTM or a mixture of CTMs. Any conventional CTM may be used in the present CTL. Typically, such CTMs are low molecular weight organic compounds with arylamine or hydrozone groups. Suitable CTM are disclosed in U.S. Pat. Nos. 3,037,861, 3,232,755, 3,271,144, 3,287,120, 3,573,906, 3,725,058, 3,837,851, 3,839,034, 3,850,630, 4,746,756, 4,792,508, 4,808,506, 4,833,052, 4,855,201, 4,874,682, 8,882,254, 4,925,760, 4,937,164, 4,946,754, 4,952,471, 4,952,472, 4,959,288, 4,983,482, 5,008,169, 5,011,906, 5,030,533, 5,034,296, 5,055,367, 5,066,796, 5,077,160, 5,077,161, 5,080,987, 5,106,713, and 5,130,217, which are incorporated herein by reference. Preferred CTM include the diphenylhydrazone derivatives 1-pyrenealdehyle dephenylhydrazone (PY-DPH) and 3-carbazolealdehyde diphenylhydrazone (CZ-DPH).

PY-DPH

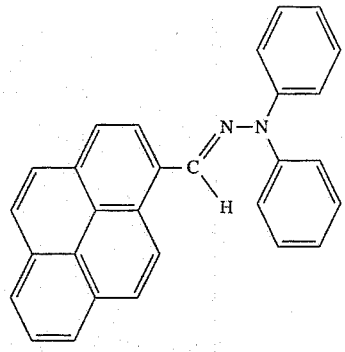

CZ-DPH

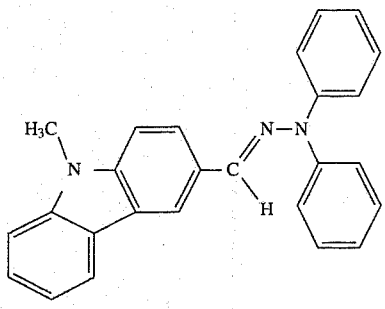

Suitably, the present CTL will contain the copolycarbonate and the CTM in a weight ratio of 70:30 to 40:60, preferably 55:45 to 45:55, most preferably about 50:50. The CTL may further comprise antioxidants, electron acceptors to stabilize residual charge, and a silicone leveling oil.

The present CTL may be prepared by conventional methods. Typically, the copolycarbonate and the CTM are dissolved in an appropriate solvent, the resulting solution is coated on a substrate, and the resulting coat is dried to afford the CTL. Suitable solvents for dissolving the copolycarbonate and the CTM include methylene chloride, methyl ethyl ketone, tetrahydrofuran, dioxane, chlorobenzene, and mixtures thereof. Typically, the copolycarbonate and the CTM are dissolved in the solvent in relative amounts which correspond to the weight proportions of copolycarbonate and CTM desired in the CTL. In absolute terms, the copolycarbonate and the CTM are each dissolved in the solvent to a total solids concentration of 5 to 50 wt. %, preferably 20 to 30 wt. %.

The solution containing the copolycarbonate and the CTM may be coated on the substrate by any conventional method, including spray coating, nozzle coating, spin coating, and dip coating. For the production of organic photoconductive imaging receptors, the solution is typically coated on the substrate by dip coating. Dip coating to form a CTL is well known to those skilled in the art, and the production of a CTL having a desired thickness can be readily achieved by varying the rate of removal of the substrate from the coating solution, the viscosity of the solution, and/or the solid content of the solution. Typically, the present CTL will have a thickness of 10 to 50 μm, most preferably 15 to 30 μm.

Suitably, the substrate can take on a variety of sizes and shapes, such as pipes, discs, plates, belts, etc., and be made from a wide range of rigid or flexible materials. When preparing an organic photoconductive imaging receptor for a photocopier or laser printer, it is preferred that the substrate be in the form of a hollow cylinder, called a pipe or drum, and is made of a conductive metal.

Although there are no particular size limitations placed on the metal drum, such drums are typically a hollow cylinder which is 10 to 100 cm long and 2 to 30 cm in outer diameter. Typically, the thickness of the drum is 0.5 to 5 mm, and thus the inner diameter of the drum is usually close in size to the outside diameter of the drum.

There is no particular limitation on the metal which composes the metal drum, and any of those used conventionally in the art may be employed. Preferably, the metal drum is an anodized and sealed aluminum drum. Such anodized aluminum drums may be prepared by the conventional methods well known in the art.

When preparing an organic photoconductive imaging receptor, the substrate (metal drum) will usually be coated with a CGL layer prior to the formation of the CTL. Thus, the organic photoconductive imaging receptor of the present invention will typically be an anodized aluminum drum which is coated on its outside surface with a CGL which in turn is coated with the present CTL. In certain cases, a thin (submicron) charge-blocking layer consisting of an insulating polymeric resin may be interposed between the metal drum surface and CGL. As noted above, together the CGL and CTL are collectively referred to as the photoreceptive layer.

The CGL can be formed on the drum by dip coating in same way that the CTL is formed on the drum. Typically, the CGL will comprise a finely divided photogeneration compound such as a phthalocyanine or bisazo pigment dispersed in an organic coating solvent, and sterically stabilized by a dissolved resin such as poly(vinyl butyral). This CGL coating solution is prepared by grinding a suspension of the pigment in an organic solvent such as cyclohexanone, isopropanol, or monoglyme with glass beads in a sand mill for several hours at low temperature, then pouring the dispersion in a solution of the stabilizing polymer. More detail is given in the Photoreceptor Examples below.

Depending on the final application of the photoconductor drum, the entire outside surface of the drum may be coated with the photoconductive layers or the photoconductive layer may be omitted from either one or both of the end portions of the outside surface of the photoconductor drum. The omission of the photoconductive layer from a single end region of the drum may be accomplished by simply controlling the depth of immersion of the drum into the coating bath during the coating step, and the omission of the photoconductive coating from both ends of the drum can be accomplished by combining controlling the depth of immersion with either wiping the end portion of the drum immersed in the coating bath or equipping this end portion with a mask during immersion.

The drying of the CTL coat to afford the CTL can be carried out using conventional methods. The exact temperature and time for the drying will depend on such factors as the thickness of the CTL, the solvent used in the coating process, and the concentration of the copolycarbonate and CTM in the coating solution. Typically, good results are achieved by drying in an oven at a temperature of from 100° to 135° C., for a time of 20 to 40 min.

Figure 2:
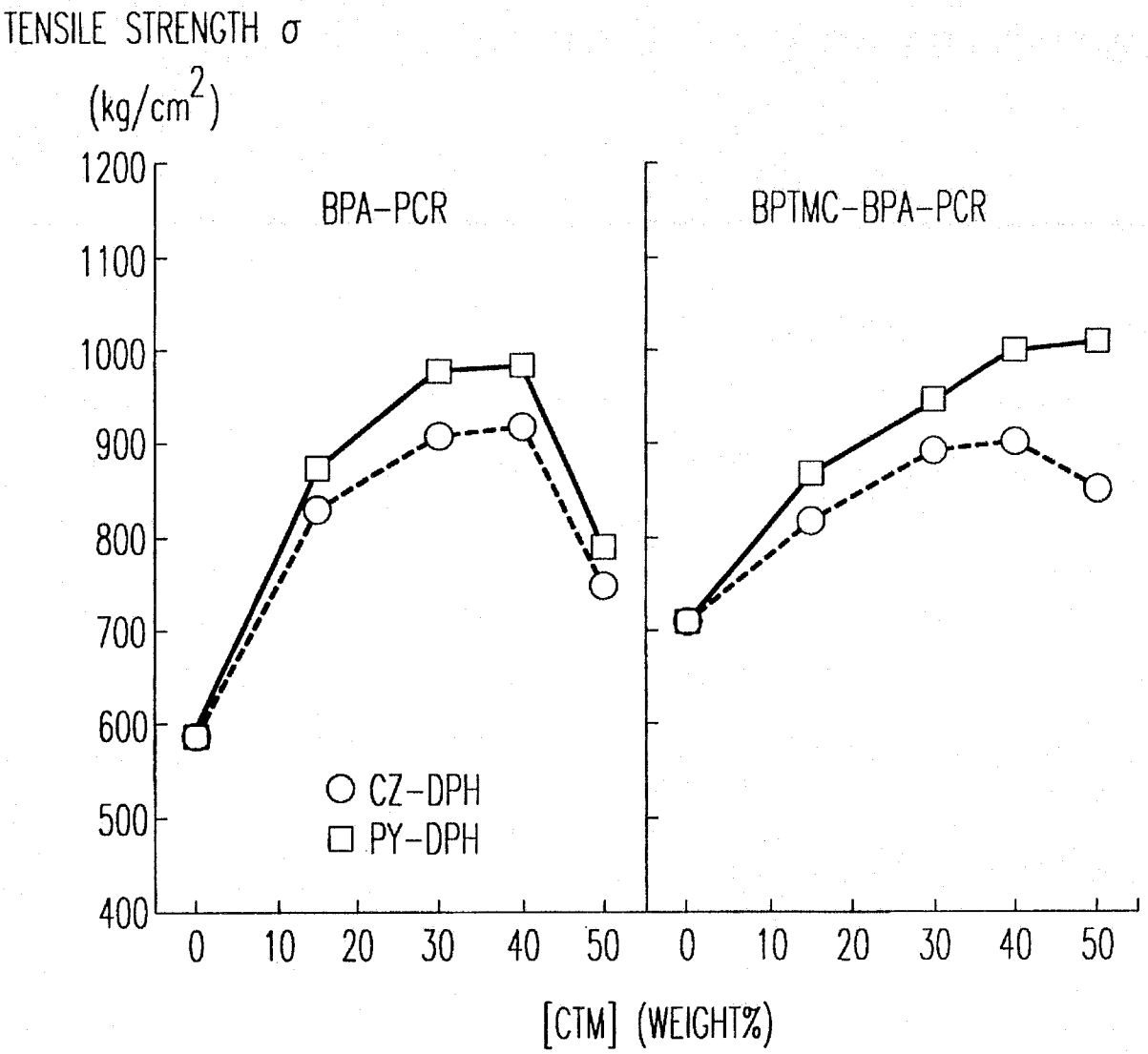
FIG. 2 shows the tensile strength at yield of 1 mm thick injection-molded tensile test bars of a mixture of copolycarbonate (either BPA-PCR or BPTMC-BPA-PCR) with CTM as a function of the amount of CTM (O, CZ-DPH; □, PY-DPH)

According to the present invention, a durable CTL layer for organic photoreceptive imaging receptors is provided which incorporates a binder resin that has 1) a high temperature primary relaxation (α peak), above 175° C. and below 230°; and 2) a broad and intense sub-$T_g$ mechanical relaxation process (high loss-modulus γ peak). Dilution of the binder resin by molecular doping with a CTM lowers the glass transition temperature, $T_g$, significantly (see FIG. 1). Therefore, it is important that the binder resin have a high initial $T_g$ so that it is not depressed close to the maximum service temperature by incorporation of the CTM. Ideally, the CTL should have a high heat-distortion temperature; i.e. a final $T_g$ above 60° C., so that under high-temperature storage or operating conditions the layer does not soften and deform under contact pressure. Addition of the CTM also increases the tensile strength of the CTL by antiplasticization as shown in FIG. 2, and this strength affects abrasion resistance. Furthermore, the temperature dependence of the loss modulus curve, as revealed by dynamic mechanical analysis (see FIG. 3), is important. The optimum condition is obtained when the secondary sub-$T_g$ relaxation (γ peak) maximum overlaps the desired service temperature of the photoconductor for efficient coupling of external stress to internal molecular motions which absorb and dissipate stress (frictional heat). In the case of BPA-PCR, the secondary γ relaxation process is well below room temperature (see FIG. 3, curve (I)), so that the loss modulus at the normal service temperature of 20° C. has a negligible contribution from this mechanism of stress dissipation.

Other features of the invention will become apparent in the course of the following descriptions of exemplary embodiments which are given for illustration of the invention and are not intended to be limiting thereof.

EXAMPLES

Materials and Methods

Materials. Two diphenylhydrazone (DPH) derivatives were utilized. They are denoted PY-DPH and CZ-DPH, according to the structure of their precursor aldehyde. These charge-transport molecules were electrophotographic-grade materials with at least 98% purity and were synthesized by the usual procedure. Some relevant physical properties are given in Table I. BPTMC-BPA-PCR samples were commercial resins provided by Bayer Corporation under the tradename "APEC", and they were used as received without additional purification. Commercial bisphenol A polycarbonate (BPA-PCR) and BPZ-PCR were chosen for the reference CTL binder resins. Relevant physical properties of BPA-PCR and BPZ-PCR are given in Table II.

Mechanical Tests

Sample Preparation. The polycarbonate and diphenylhydrazone derivative were dissolved separately in tetrahydrofuran (20 and 25 wt. %, respectively), and these master batch solutions were passed through a 10-μm Millipore filter under pressure to remove traces of dust, which might act as crack nucleation sites during fracture testing. Afterward, the master batches were intimately mixed to give solutions having various DPH concentrations, equal to 15, 30, 40, and 50 wt. % solids (total solid content=120 g). These solutions were then evaporated in a forced-air oven, with the temperature raised in stages from 60° to 140° C. over a 7 hour period.

BPTMC-BPA-PCR is amorphous and highly soluble and did not phase separate during solvent evaporation. This is an advantage compared to BPA-PCR, which had a tendency to crystallize during drying, particularly at high polymer concentration. Complete remixing was ensured by melt compounding (see below). Phase separation of the DPH CTM was not a problem, provided its concentration was not above 60 wt. %. Such demixing is not usually a problem for thin films (e.g., 25 μm) applied by dip coating to actual photoconductor drums (see Photoreceptor Examples), which dry very rapidly to a rigid glassy state.

Next, the solid CTL mix was cut into pellets, which were ground to less than 2 mm by a Fitz mill. Some solids had high-impact toughness, which necessitated cooling with liquid nitrogen before grinding. The powders so obtained were vacuum dried for about 18 h just below $T_g$ to eliminate traces of solvent and absorbed water and fed into a single-screw injection-molding machine to fabricate mechanical test bars. Injection molding was superior to melt pressing and solvent casting for obtaining large, uniform samples that were dry and free from voids, and suitable for the following tests.

Thermal Analysis. Thermal gravimetric analysis (TGA) was used to determine the onset of thermal decomposition ($T_d$) in air, and Tg values (or $T_m$=melting point, where applicable) were recorded by differential scanning calorimetry (DSC). Tg was determined for thermally annealed CTL solids as the first inflection point during heating, and $T_m$ was taken as the maximum endotherm position. Crystalline CTM were first melted and then rapidly quenched to −80° C. to

TABLE I

Some Properties of Diphenylhydrazone Charge-Transport Molecules (CTM)[a]

| CTM name | formula | formula wt | $T_g$ °C. | $T_m$ °C. | $T_d$ °C. | cryst density, g/cm³ | glass density, g/cm³ | $I_p$, eV |
|---|---|---|---|---|---|---|---|---|
| PY-DPH | $C_{29}H_{20}N_2$ | 396.5 | 42 | 128 | 250 | 1.28 | 1.20 | 7.0 |
| CZ-DPH | $C_{26}H_{21}N_3$ | 375.5 | 54 | 157 | 250 | 1.25 | 1.17 | 6.8 |

[a]$T_g$ is the glass transition temperature, $T_m$ is the melting point, $T_d$ the decomposition temperature in air, and $I_p$ the ionization potential.

TABLE II

Some Properties of Homopolymer Polycarbonate Binder Resins[a]

| PCR name | repeat unit formula | repeat unit formula wt | $T_g$ °C. | $T_\gamma$ °C. | glass density, g/cm³ | $\bar{M}_v \times 10^{-4}$ |
|---|---|---|---|---|---|---|
| BPA-PCR | $C_{16}H_{14}O_3$ | 254.3 | 150 | −110 | 1.198 | 2.82 |
| BPZ-PCR | $C_{19}H_{18}O_3$ | 294.4 | 180 | −70 | 1.201 | 2.0 |

$\bar{M}_v$ is the viscosity-average molecular weight.

form the amorphous (glassy) phase. The effect of CTL binder resin type and concentration of DPH CTM is shown in FIG. 1. It is evident that for all compositions, higher $T_g$ values are obtained with the copolycarbonate BPTMC-BPA-PCR (n=36) compared to the standard homopolymer BPA-PCR. These higher $T_g$ values impart improved resistance to heat distortion.

TABLE III

Tg of BPTMC-BPA as a Function of the Molar Ratio of BPTMC to BPA.

| n | Tg |
|---|---|
| 100 | 245° C. |
| 56 | 205° C. |
| 36 | 186° C. |
| 10 | 160° C. |
| 0 | 150° C. |

Tensile Test and Aging. An Intesco Model 2005 tensile tester was used to record the extensional stress-strain (force-deformation) curves of the injection-molded test bars at ambient temperature. Tensile bars were extended to the point of break in the longitudinal direction, after being aged for 1 week at room temperature.

The properties of PCR are known to change with time due to aging. This aging phenomenon usually results in densification (relaxation of excess free volume), accompanied by an increase in brittleness. Partial relaxation of internal stress was possible by annealing near the glass transition temperature for a sufficiently long period. FIG. 2 shows the increase in tensile strength caused by the antiplasticization effect of the specified DPH CTM. Furthermore, at 50 weight % CTM, the most advantageous combination is afforded by BPTMC-BPA-PCR (n=36) and CZ-DPH.

Figure 3:
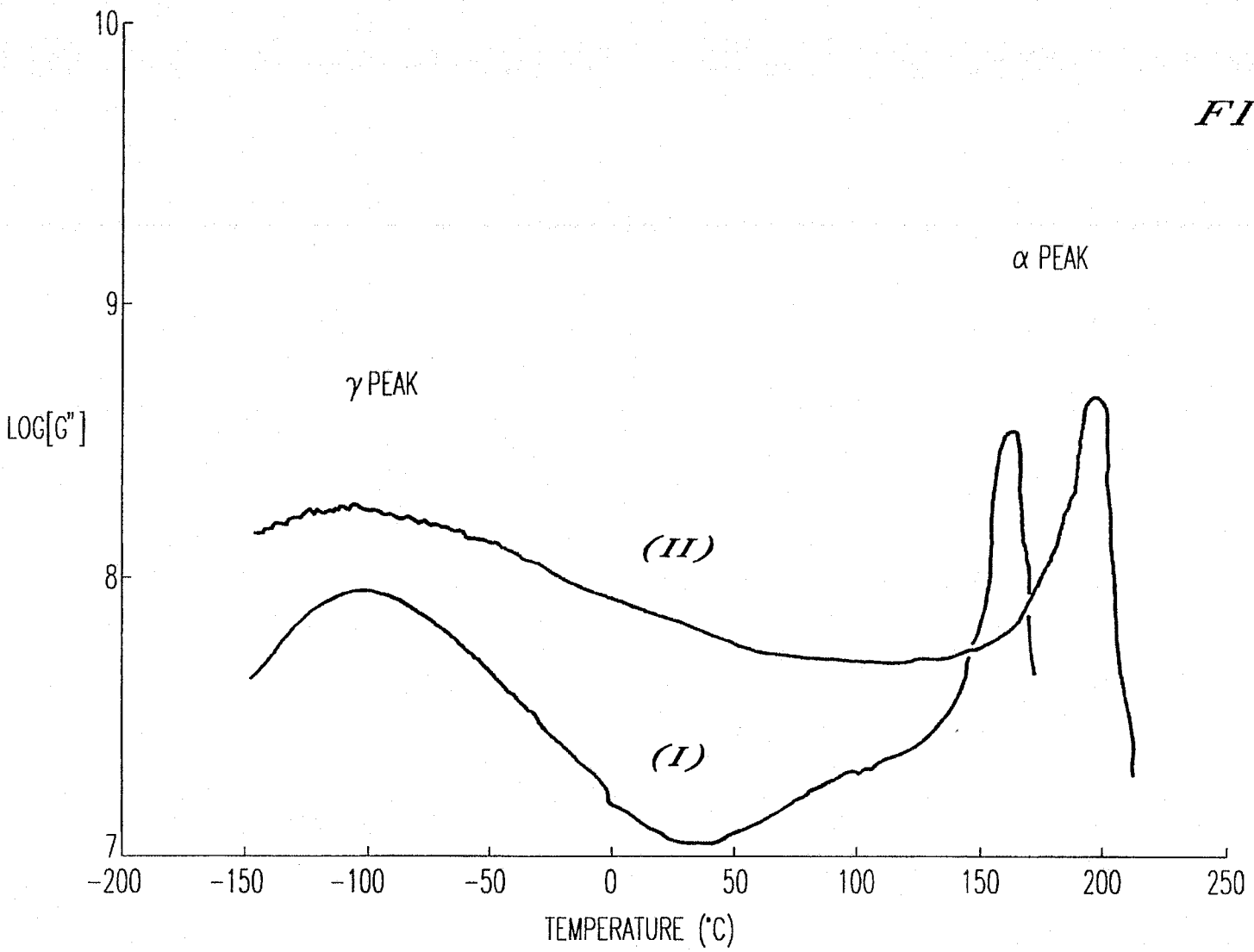
FIG. 3 shows the dynamic-mechanical loss moduli at 1 Hz cyclic stress frequency for two copolycarbonates (I, BPA-PCR; II, BPTMC-BPA-PCR)

Dynamic Mechanical Analysis. Dynamic mechanical analysis (DMA) was performed from −150° to about +15° C. above $T_g$ at a heating rate of 1.5° C.•min$^{-1}$ with a Du Pont 983 instrument operating in the oscillating forced flexural mode (amplitude 0.2 mm), at a fixed frequency of 1 Hz. This frequency was chosen because of its close match to the actual copy machine process speed. The solid sample was an injection-molded bar, 7 mm wide and 3 mm thick, with a length between clamps of 18 mm. $T_g$ was assigned to the maximum position of the α peak in the loss modulus (G") curve. FIG. 3 shows the dynamic-mechanical loss moduli of BPA-PCR (I) and BPTMC-BPA-PCR with n=36 (II). The advantages of the exemplified copolycarbonate BPTMC-BPA-PCR claimed herein are the higher heat distortion temperature, as revealed by the α peak, and the improved dissipation of abrasive stress, as revealed by the broader and more intense γ peak. In particular, the γ peak of BPTMC-BPA-PCR is significantly more intense in the normal copier and printer service environment from 5° to 35° C.

Figure 4:
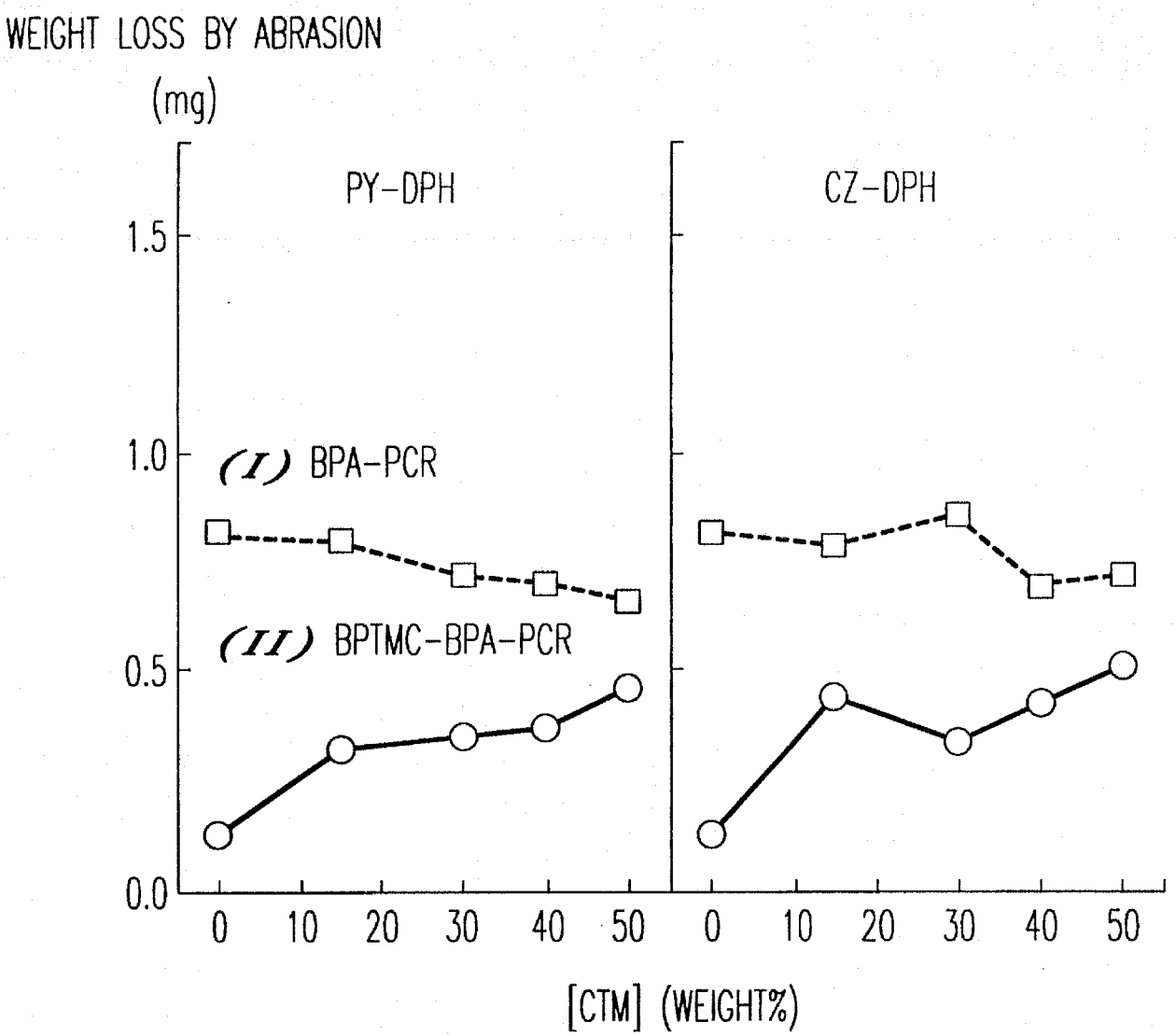
FIG. 4 shows the abrasion of CTL test sheets of BPA-PCR, □, and BPTMC-BPA-PCR, O, containing PY-DPH or CZ-DPH by the Taber method as a function of the amount of CTM.

Film Abrasion Test. CTL mixtures in a methylene chloride solution were draw-bar-coated on a 100-μm aluminized polyester sheet, to provide a solid film having a thickness of 35 μm after drying, and 120-mm-diameter circles were cut out for abrasion testing. A Taber-type abrader was used (manufactured by Toyoseiki Co.), utilizing two Kent paper-covered abrasive disks with a 250-g load, according to industrial standard JIS K7204 (1977). FIG. 4 shows the weight loss of CTL film by the Taber method. BPTMC-BPA-PCR shows significantly improved abrasion resistance by this test compared to the reference homopolymer BPA-PCR.

Photoconductive Imaging Receptor. This example describes, but is not limited to, the preparation by dip coating of photoconductive imaging members having a cylindrical drum configuration. Photoconductive sheets and belts may also lie within the scope of this invention by choice of the appropriate substrate and coating methodology.

The substrate to be coated is a hollow aluminum cylinder or drum, with a diameter from 30 to 100 mm, and a length from 250 to 1000 mm, with a surface that may be either mirror finished by diamond turning, or anodized to create a charge-blocking layer. This surface is cleaned and degreased by either trichloroethylene or aqueous-based detergents with the application of ultrasonic radiation, vapor rinsing, and/or brush scrubbing. All subsequent coating operations take place in a clean-room environment.

The first coating layer to be applied is the charge-generating layer (hereafter referred to as the CGL), which is applied by dipping the drum into a solution of specified composition and withdrawing the drum at a precise speed so as to obtain a uniformly coated film with precisely defined thickness. The CGL coating solution is prepared by standard procedures well known in the industrial preparation of organic photoconductors. Briefly, the solution consists of a colloidal dispersion of submicron charge generating pigment particles stabilized by dispersion in a solution of poly(vinyl butyral) resin dissolved in dimethoxyethane. Then the solution is added to a coating bath of suitable dimensions, positioned so that the aluminum drum may be vertically dipped at a controlled rate. After the CGL is applied to the surface of the aluminum drum and dried to achieve a dry thickness ranging from 0.1 to 1.0 μm, the drum is transported to the second dip-coating station to receive the charge-transport layer (hereafter referred to as CTL).

The application of the CTL is also performed according to conventional methods with the exception that the novel copolycarbonate resins which are the subject of the present disclosure are utilized. Thus, the coating solution is prepared by dissolving nearly equal parts by weight of the novel copolycarbonate binder resin and a charge-transport material, which typically may be an aromatic hydrazone and/or amine derivative, in tetrahydrofuran or dioxane. It is applied to the drum, already coated with the CGL, by an analogous dip-coating technique. The velocity of withdrawal of the drum from the solution of charge-transport materials is precisely controlled, to obtain a CTL thickness between 15 and 30 μm after drying. Final drying of the device is achieved by placing the bilayer-coated drum in a forced-air oven maintained at a temperature between 100° and 130° C. for 20 to 35 minutes.

Figure 5:
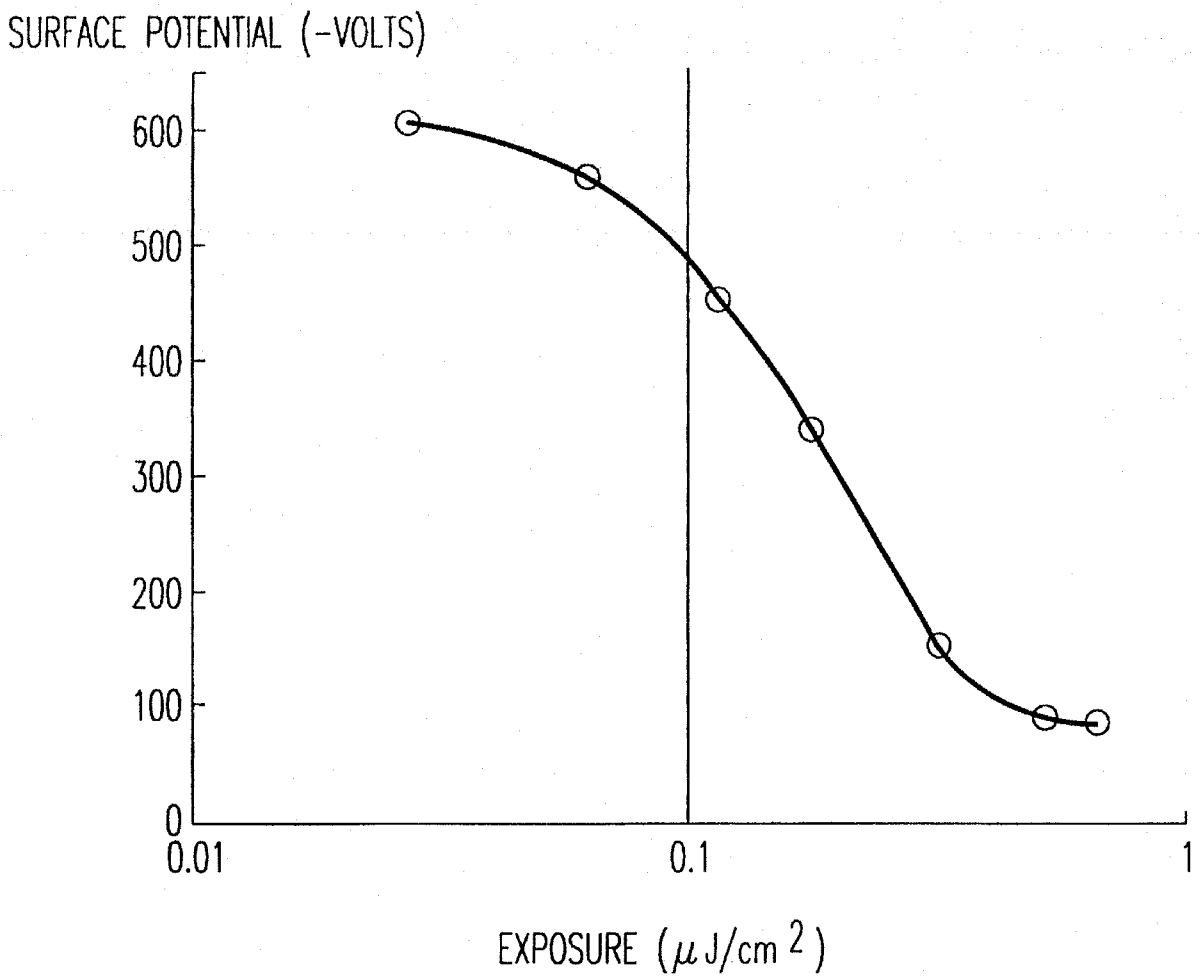
FIG. 5 shows the photo-induced discharge curve (PIDC) of a complete functioning photoreceptor device incorporating a CTL according to the present invention.

Photosensitivity is measured by an Electrophotographic Drum Scanner, which performs a dynamic cycle of charging, exposing, measuring, and erasing the drum, which is rotated at an angular velocity corresponding to the process speed of the desired copier and/or printer application. The exposing light may be either panchromatic white light from a tungsten lamp, or monochromatic light obtained by appropriate filtration. FIG. 5 shows the photo-induced discharge curve (PIDC) obtained for Photoreceptor Example 6, utilizing a 30 mm diameter aluminum drum, and exposure by monochromatic light at 780 nm, as used for laser-beam printers. One key electrophotographic parameter for optimum device performance is the exposure required to obtain half discharge of the initial surface electrostatic potential. This exposure is commonly referred to as $E_{1/2}$. For example, if the initial potential on the organic photoreceptor surface is −700 Volts, then $E_{1/2}$ is the exposure energy required to photodischarge the organic photoreceptor surface to −350 Volts. Another key parameter is the residual potential $V_R$, which is the voltage remaining in the photoreceptor that cannot be discharged over a reasonable process time by saturation exposure.

A key test of binder materials used to fabricate organic photoconductive imaging receptors is that they do not have a deleterious effect on $E_{1/2}$ and $V_R$. The results in FIG. 5 show that the present copolycarbonates allow excellent photoelectrical discharge properties to be obtained.

Photoreceptor Examples 1–6

The present invention may be understood in still more detail by reference to the following illustrative Examples of actual functioning photoreceptor devices, again without limiting the scope of the invention in any way.

Photoreceptor Example 1

Onto an aluminum drum 30 mm in diameter and 348 mm in length a solution consisting of the materials below, prepared by sand-mill dispersion for 18 hours, was applied by the aforementioned dip-coating process to form a charge-generating layer 0.7 μm thick.

| Material | Type | Parts by Weight |
|---|---|---|
| Charge generation pigment | oxadiazole bisazo pigment (I) | 100 |
| Binder Resin | Polyvinyl butyral acetal | 50 |
| Solvent | Monoglyme | 4000 |

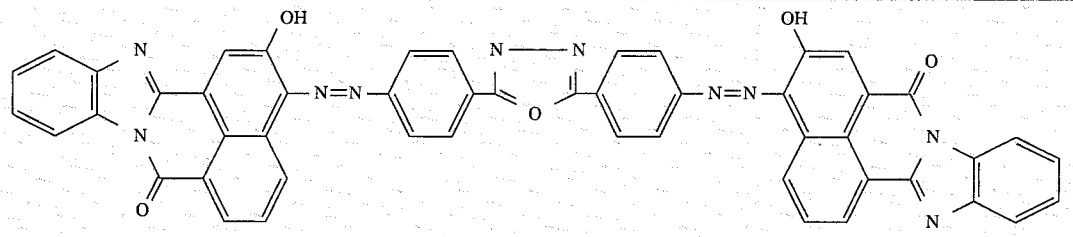

100 Parts by weight of the standard reference CTL binder resin BPA-PCR with $M_v$=28,200 Daltons and $T_g$=150° C. was dissolved with 95 parts by weight of the CTM PY-DPH in tetrahydrofuran and coated to form a CTL 21 μm thick.

Abrasion resistance of the complete functional photoreceptor device was tested in a commercial photocopy machine made by Sharp corporation model, SF-7850, operating at a linear process speed of 100 mm/sec. The abrasion results are shown in Table IV.

Photoreceptor Example 2

A photoreceptor was prepared and evaluated in the same manner as in Example 1, except that the exemplified compound BPTMC-BPA-PCR copolycarbonate with n=36, $T_g$=186° C., and $M_v$=22,000 Daltons was used. The abrasion results are shown in Table IV.

Photoreceptor Example 3

A photoreceptor was prepared and evaluated in the same manner as in Example 1, except that the exemplified compound BPTMC-BPA-PCR copolycarbonate with n=56, $T_g$=205° C., and $M_v$=22,100 Daltons was used. The abrasion results are shown in Table IV.

Photoreceptor Example 4

A photoreceptor was prepared and evaluated in the same manner as in Example 1, except that a blend of the copolycarbonate of Example 2 with the homopolymer BPTMC-PCR with $M_v$=70,300 Daltons and $T_g$=245° C. was used. Abrasion testing for this example was not completed because of the appearance of stress cracks in the CTL surface. This result shows that CTL binders with $T_g$ values much above 200° C. are not advantageous, because internal stress created during shrinkage of the CTL during drying cannot be relieved or annealed during standard production practice; that is, the annealing conditions of temperature and time are sufficiently elevated to cause the onset of thermal decomposition in the more sensitive CTM.

Photoreceptor Example 5

A photoreceptor was prepared and evaluated in the same manner as in Example 1, except that BPZ-PCR with $M_v$=20,000 Daltons and $T_g$=180° C. was used. The abrasion results are shown in Table IV.

TABLE IV

| Photoreceptor Example No. | CTL Binder | Binder $M_v$ (Daltons) | Abrasion Loss (μm/10K) |
|---|---|---|---|
| 1 | BPA-PCR | 28,200 | 2.8 |
| 2 | BPTMC-BPA-PCR n = 36 | 22,000 | 1.3 |
| 3 | BPTMC-BPA-PCR n = 56 | 22,100 | 1.5 |
| 4 | BPTMC-BPA-PCR n = 36 | 22,000 | N.A. |
| | BPTMC-PCR n = 100 | 70,300 | |
| 5 | BPZ-PCR | 20,000 | 1.5 |

The following example now serves to illustrate the satisfactory nature of the electrophotographic discharge characteristics of complete functioning photoreceptor devices employing the exemplified copolycarbonate in the CTL, and the suitability of such devices for use with phthalocyanine pigments and laser beam exposure at 780 nm.

Photoreceptor Example 6

Onto an anodized aluminum drum 30 mm in diameter and 254 mm in length a solution consisting of the materials below, prepared by sand-mill dispersion for 1 hour according to the aforementioned procedure, was applied by a dip-coating process to form a charge-generating layer 0.5 μm thick.

| Material | Type | Parts by Weight |
|---|---|---|
| Change generation pigment | Titanium oxy phthalocyanine pigment | 100 |
| Binder Resin | Polyvinyl butyral acetal | 50 |
| Solvent | Monoglyme | 3500 |

100 Parts by weight of the exemplified CTL copolycarbonate binder resin BPTMC-BPA-PCR with $M_v$=28,200 Daltons and $T_g$=150° C. was dissolved with 90 parts by weight of the CTM CZ-DPH in tetrahydrofuran to form a CTL 21 μm thick, which was subsequently dried at 120° C. for 25 minutes. The photodischarge characteristics of this device are shown in FIG. 5.

The improved durability results from molecular characteristics of the copolycarbonate that are revealed by dynamic-mechanical analysis, namely a high-temperature primary or α stress relaxation mode (above 175° C. at 1 Hz stress frequency), which conveys a high heat-distortion resistance, coupled with a broad secondary or γ stress relaxation, that spans the temperature range −150° to +50° C. Another advantage is the amorphous nature resulting from the statistical copolymer sequence distribution, so that the copolycarbonate readily dissolves for solution-coating fabrication techniques, forms a transparent amorphous (glassy) solid phase and does not separate from this phase by crystallization.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An organic photoconductive imaging receptor, comprising:

(A) a conductive metal substrate;

(B) a charge generation layer coated on said conductive metal substrate; and (C) a charge transport layer coated on said charge generation layer;

wherein said charge transport layer comprises:

(a) a copolycarbonate comprising a statistical distribution of monomer units derived from 1,1-bis-(4 -hydroxyphenyl)-3,3,5-trimethylcyclohexane and 2,2-bis-(4-hydroxyphenyl)propane; and (b) a charge transport material;

wherein said copolycarbonate has the formula (I):

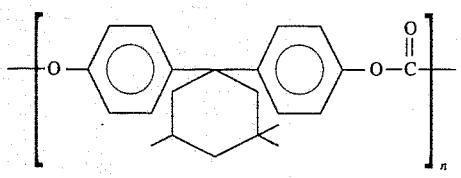

-continued

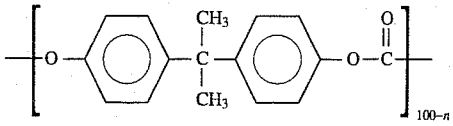

wherein n is the mole percent of monomer units derived from 1,1-bis-(4-hydroxyphenyl)-3,3,5-trimethylcyclohexane and 100-n is the mole percent of monomer units derived from 2,2-bis-(4-hydroxyphenyl)propane, and n is 10 to 90 mole % and 100-n is 90 to 10 mole %.

2. The organic photoconductive imaging receptor of claim 1, wherein n is 25 to 75 mole % and 100-n is 75 to 25 mole %.

3. The organic photoconductive imaging receptor of claim 1, wherein said charge transport material is selected from the group consisting of PY-DPH and CZ-DPH.

4. The organic photoconductive imaging receptor of claim 1, wherein said copolycarbonate and said charge transport material are present in said charge transport layer in a weight ratio of 70:30 to 40:60.

5.The organic photoconductive imaging receptor of claim 1, wherein said copolycarbonate and said charge transport material are present in said charge transport layer in a weight ratio of 55:45 to 45:55.

6. A charge transport layer, comprising:

(a) a copolycarbonate comprising a statistical distribution of monomer units derived from 1,1-bis-(4 -hydroxyphenyl)-3,3,5-trimethylcyclohexane and 2,2-bis-(4-hydroxyphenyl)propane; and (b) a charge transport material;

wherein said copolycarbonate has the formula (I):

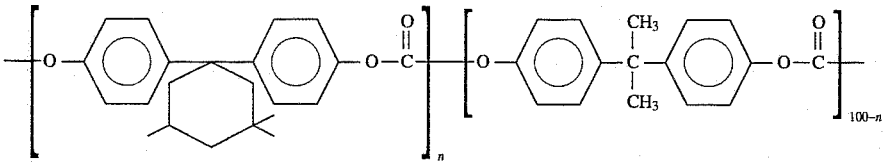

wherein n is the mole percent of monomer units derived from 1,1-bis-(4-hydroxyphenyl)-3,3,5-trimethylcyclohexane and 100-n is the mole percent of monomer units derived from 2,2-bis-(4-hydroxyphenyl)propane, and n is 10 to 90 mole %, and 100-n is 90 to 10 mole %.

7. The charge transport layer of claim 6, wherein n is 25 to 75 mole % and 100-n is 75 to 25 mole %.

8. The charge transport layer of claim 6, wherein said charge transport material is selected from the group consisting of PY-DPH and CZ-DPH.

9. The charge transport layer of claim 6, wherein said copolycarbonate and said charge transport material are present in a weight ratio of 70:30 to 40:60.

10. The charge transport layer of claim 6, wherein said copolycarbonate and said charge transport material are present in a weight ratio of 55:45 to 45:55.

* * * * *